US007341144B2

(12) United States Patent
Tajiri et al.

(10) Patent No.: US 7,341,144 B2
(45) Date of Patent: Mar. 11, 2008

(54) CASE WITH HINGED LID

(75) Inventors: Takeshi Tajiri, Yokohama (JP); Osamu Kamimura, Yokohama (JP); Yasushi Kimura, Yokohama (JP)

(73) Assignee: Hitachi Communication Technologies, Ltd., Tokyo (JP)

( * ) Notice: Subject to any disclaimer, the term of this patent is extended or adjusted under 35 U.S.C. 154(b) by 502 days.

(21) Appl. No.: 11/060,892

(22) Filed: Feb. 18, 2005

(65) Prior Publication Data

US 2005/0224508 A1 Oct. 13, 2005

(30) Foreign Application Priority Data

Apr. 12, 2004 (JP) ..... 2004-116332

(51) Int. Cl.
*B65D 43/16* (2006.01)

(52) U.S. Cl. ..... 206/320; 206/701; 220/848; 220/849; 16/386

(58) Field of Classification Search ..... 206/320, 206/701; 220/844, 848, 849; 16/386
See application file for complete search history.

(56) References Cited

U.S. PATENT DOCUMENTS 3,962,750 A * 6/1976 Buss et al. ..... 16/381
5,257,721 A * 11/1993 Smith et al. ..... 220/533
6,629,334 B2 * 10/2003 Huang ..... 16/50

FOREIGN PATENT DOCUMENTS

| | | |
|---|---|---|
| JP | 10-117072 | 5/1998 |
| JP | 10-308586 | 11/1998 |
| JP | 2002-134948 | 5/2002 |
| JP | 2002-176272 | 6/2002 |

* cited by examiner

*Primary Examiner*—Jacob K. Ackun, Jr.
(74) *Attorney, Agent, or Firm*—Townsend and Townsend and Crew LLP

(57) ABSTRACT

A case includes a case body, a lid, hinges supporting the lid on the case body and a waterproof seal placed on the joining surface of the case body. The lid can be turned for closing on the hinges so as to compress the waterproof seal perpendicularly to the joining surface of the case body. Each hinge is provided with a hinge pin having opposite cylindrical end parts and an offset middle part defining a groove together with the cylindrical end parts. The grooves of the hinges permit first knuckles formed integrally with the lid to sink therein so that the lid held with its joining surface parallel to the joining surface of the case body can be moved toward the case body perpendicularly to the joining surface of the case body to compress the waterproof seal perpendicularly between the joining surfaces of the lid and the case body. The hinge pin is restrained from coming off by the first knuckles when the first knuckles are engaged in the groove.

20 Claims, 9 Drawing Sheets

CASE WITH HINGED LID

CROSS-REFERENCES TO RELATED APPLICATIONS

This application is related to and claims priority from Japanese Patent Application No. 2004-116332, filed Apr. 12, 2004, and is hereby incorporated by reference for all purposes.

BACKGROUND OF THE INVENTION

The present invention relates to a hinge for a waterproof electronic device holding case and, more particularly, to a hinge capable of improving the waterproofing ability of a waterproof seal placed between the open end of an electronic device holding case and a lid.

A waterproof outdoor electronic device holding case proposed in JP 2002-134948 A or JP 10-308586 A has a case body and a lid connected to the case body by hinges. The lid is turned (pivots) on the hinge pins of the hinges for opening and closing. An electronic device holding case proposed in JP 10-117072 A or JP 2002-176272 A has a case body, a lid and a waterproof seal placed between the open end of the case body and the lid so as to be compressed between the case body and the lid. In this electronic device holding case, a lid fixing screw serves as a shaft for fastening a hinge to the lid, the lid fixing screw is connected to the hinge pin of the hinge, the lid is moved on one side by unfastening the screw to move the lid for opening and closing.

In those prior art electronic device holding cases, the lid turns on the hinge pin. When the lid is turned for closing on the hinge pin and the lid is almost completely closed, a compressive force compressing the seal acts in a direction at an angle $\alpha$ to a normal to the end surface of the case body on which the seal is placed as shown in FIG. 13. Consequently, a part of the seal nearer to the hinge cannot be compressed perpendicularly to the end surface of the case body, i.e., a contact surface of the case body with which the lid comes into close contact, and hence, in the seal, a possibility of not exercising an original waterproof function properly exists due to twisting or jamming. A waterproof seal proposed in JP 11-4084 A is provided with a plurality of protrusions capable of exercising a waterproof function when compressed even by a low force. Even an O-ring must be compressed perpendicularly to prevent the O ring from twisting and jamming.

The lid fixed with a hinge nut as mentioned in Patent document 3 or 4 is able to compress the seal properly. However, since the lid is fixed to the case body by the screw connected to the hinge and the movement (stroke) of the lid is dependent on the degree of screwing of the fixing screw as shown in FIG. 14, the lid does not necessarily follow a fixed path when the lid is opened or closed. For example, if the stroke of the lid is long, the axis of a fixing bolt 18 shown in FIG. 14 are liable to be tilted at an angle $\beta$ to a normal to a contact surface between the lid and the case body. Consequently, the lid is dislocated in a lateral direction $\eta$ and cannot be correctly positioned relative to the case body and hence close attention must be paid to avoid the twisting and jamming of the seal.

A hinge nut 19 must have a strength to withstand a squeezing force exerted thereon by the fixing bolt 18 and the resilience of the seal. Therefore, there are restrictive conditions for the size and material of the hinge nut 19 and hence it is difficult to form the hinge in a small size and small weight. The hinge nut needs machining work such as threading work.

Generally, fixation of a hinge to a case body needs troublesome work, such as screwing screws, press-fitting a hinge pin or staking a hinge pin after inserting the hinge pin in a bore, which increases man-hour.

SUMMARY OF THE INVENTION

The present invention provides a case including a case body, a lid, a seal placed on a joining surface of the case body, and hinges each having a first knuckle formed integrally with the lid, second knuckles formed integrally with the case body so as to lie on the opposite side of the first knuckle, and a hinge pin on which the first knuckle formed integrally with the lid turns (pivots); wherein the hinge pin has opposite cylindrical end parts and an offset middle part extending between the cylindrical end parts so as to form a groove between the cylindrical end parts, the first knuckle is capable of sinking in the groove to compress the seal perpendicularly between the lid and the case body. Accordingly, the seal can be prevented from twisting or jamming.

Each of the second knuckles formed integrally with the case body is provided with a bore, the first knuckle formed integrally with the lid is provided with a bore and is inserted in a space between the second knuckles of the case body, and the hinge pin is inserted in the respective bores of the first and the second knuckles. The lid is able to turn on the hinge pin and to move in a direction perpendicular to the joining surface of the case body by a distance corresponding to the depth of the groove.

According to the present invention, the seal can be compressed between the case body and the lid perpendicularly to the joining surface of the case body and the lid is restrained from dislocation relative to the case body. Consequently, the seal can be prevented from twisting or jamming and is able to seal the joint of the case body and the lid satisfactorily. Accordingly, the waterproofing ability is improved.

Since any lid fixing screw does not need to be connected to the hinge pin, the hinge pin needs to have a diameter and strength enough only to hold the lid. Therefore, the hinge pin of the hinge according to the present invention is smaller than the hinge nut 19 and may be formed of a plastic material while the hinge nut 19 is formed of a metal. Thus the device is lightweight and can be manufactured at a low cost.

The first knuckle sunk in the groove restrains the hinge pin from axial movement and holds the hinge pin in place when the lid is closed, the hinge pin is prevented from falling off the knuckles, work for press-fitting the hinge pin or fixing the hinge pin to the case body with a screw is unnecessary and hence assembling work can be reduced.

BRIEF DESCRIPTION OF THE DRAWINGS

Details of embodiments of the invention are discussed below in connection with the following figures.

DETAILED DESCRIPTION OF THE INVENTION

Figure 1:
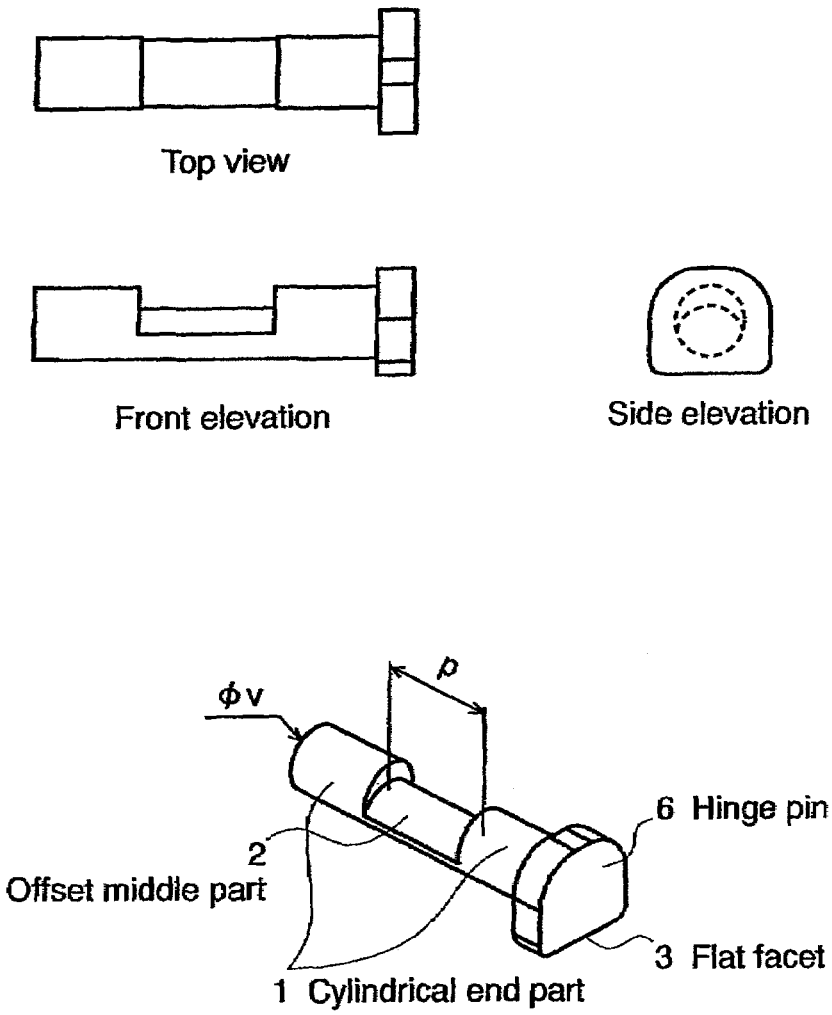
FIG. 1 is a front elevation, a side elevation and a perspective view of a hinge pin.

The basic constitution of the present invention will be described with reference to FIGS. 1 to 4. FIG. 1 is a perspective view of a hinge pin 6, which is a principal structural component of a case in a preferred embodiment according to the present invention. The hinge pin 6 has opposite cylindrical end parts 1, an offset middle part 2 extending between the cylindrical end parts 1, and a head 3 formed integrally with one of the cylindrical end parts 1 and having a flat facet. A groove is defined by the inner end surfaces of the cylindrical end parts 1 and the offset middle part 2. The flat facet of the head restrains the hinge pin 6 from rotating during opening and closing operations of the lid.

Figure 2:
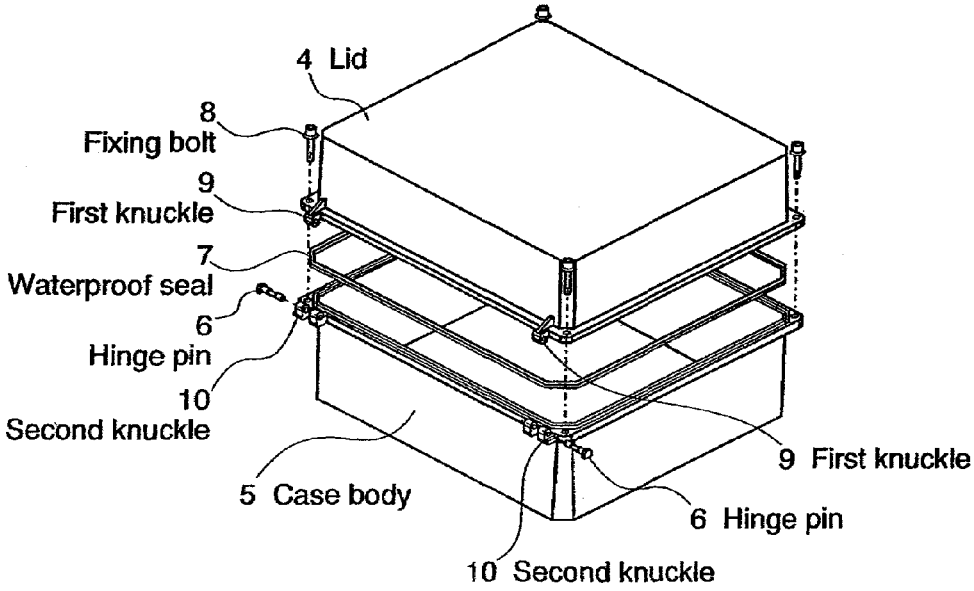
FIG. 2 is an exploded perspective view of a case.

FIG. 2 is an exploded perspective view of a case in a preferred embodiment according to the present invention provided with the hinges respectively including the hinge pins 6. The case has a lid 4, a case body 5 for holding a wiring board provided with electronic devices, hinges including the hinge pins 6, a waterproof seal 7 for sealing the gap between the lid 4 and the case body 5 in a liquid-tight fashion to prevent the leakage of rainwater and liquids into the case body 5, fixing bolts 8 fixing the lid 4 to the case body 5 so as to squeeze the waterproof seal 7, first knuckles 9 each formed integrally with the lid 4 and engaged with the offset middle part 2 of the hinge pin 6, and second knuckles 10 formed integrally with the case body 5 and respectively engaged with the cylindrical end parts 1. The first knuckles 9 may be formed integrally with the case body 5 and the second knuckles 10 may be formed integrally with the lid 4. It is preferable to form the first knuckles 9 and the second knuckles 10 as shown in FIG. 2 because the case body 5 is heavier than the lid 4 in most cases. The fixing bolts 8 fasten together the lid 4 and the case body 5 so that the waterproof seal 7 may be compressed between the lid 4 and the case body 5. The positions, the numbers and the shapes of the fixing bolts 8 are not limited to those in this embodiment.

Figure 3:
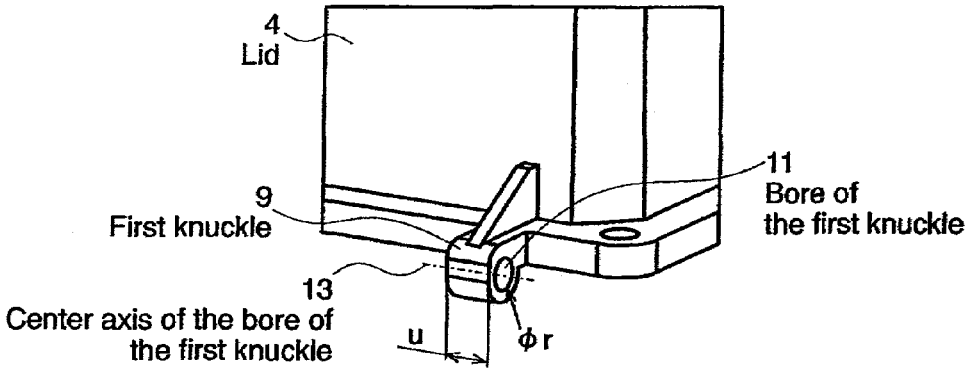
FIG. 3 is an enlarged perspective view of a first knuckle formed integrally with a lid.
Figure 4:
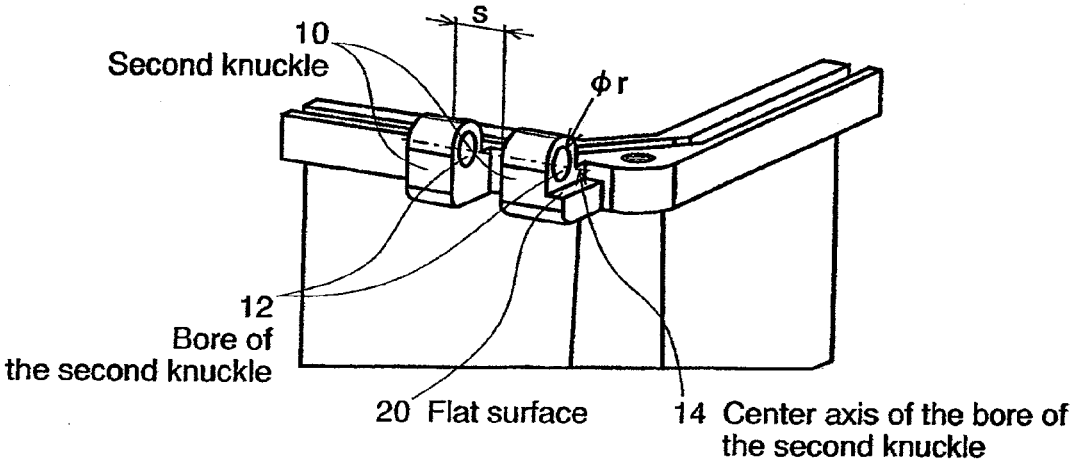
FIG. 4 is an enlarged perspective view of second knuckles formed integrally with a case body.

FIG. 3 is a fragmentary, enlarged perspective view of the knuckle 9. The first knuckle 9 is provided with a bore 11 for receiving the offset middle part 2 of the hinge pin 6. FIG. 4 is an enlarged perspective view of the second knuckles 10 formed integrally with the case body 5. The second knuckles 10 are provided with bores 12 for receiving the cylindrical end parts 1 of the hinge pin 6, respectively. One of the two second knuckles 10 has a part provided with a flat surface 20 that engages with the flat facet of the head 3 to restrain the hinge pin 6 from rotating within the knuckles. Thus the hinge pin 6 is restrained from rotating relative to the case body 5 when the lid 4 is opened or closed. Preferably, the hinge meets a condition expressed by an inequality: $s \geqq u$, where s is the distance between the inner end surfaces of the two second knuckles 10 and u is the length of the first knuckle 9. The distance s may be greater than the length u such that the lid 4 can be properly positioned relative to the case body 5 in a desired positional accuracy. In a trial case, the distance s was 10.5 mm and the length u was 10.0 mm.

The relation of $p \geqq s$ is preferable, where p is the distance between the inner end surfaces of the cylindrical end parts 1 of the hinge pin 6. When $p \geqq s$, the first knuckle 9 can be surely set in a space between the inner end surfaces of the cylindrical end parts 1. In the trial case, the distance s was 10.5 mm and the distance p was 11 mm.

Referring to FIGS. 3 and 4, it is preferable that the respective diameters r of the bore 11 of the first knuckle 9 and the bores 12 of the second knuckles 10 and the diameter v of the cylindrical end parts 1 meet an inequality: $r>v$ to facilitate work for inserting the hinge pin 6 in and extracting the same from the bores 11 and 12 and work for assembling the case. In the trial case, the diameter r was 6.0 mm and the diameter v was 5.8 mm.

Figure 5:
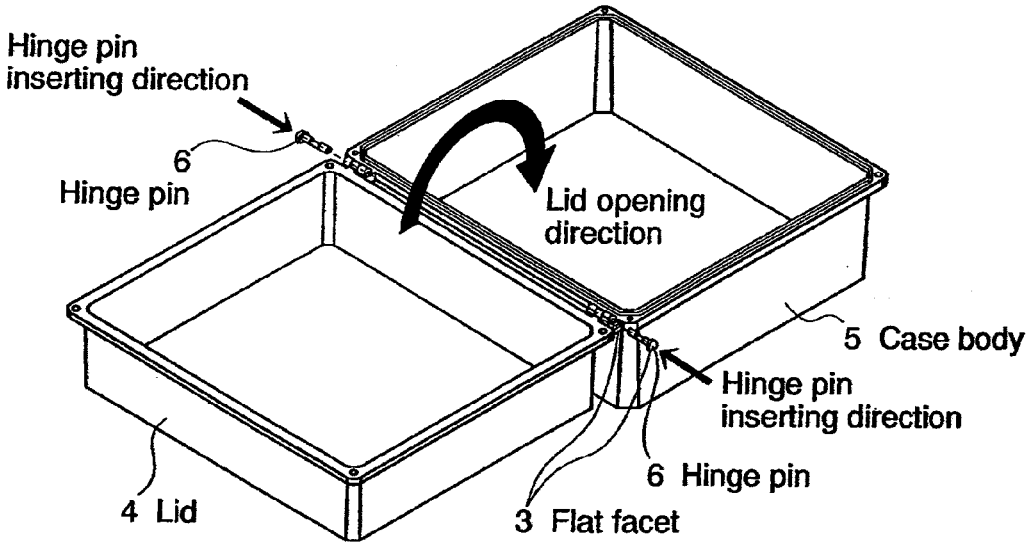
FIG. 5 is a perspective view of the case in a state where the lid is open.

An assembling procedure for assembling the case of the present invention provided with the hinge pins 6 will be described in connection with FIG. 5. Each of the two first knuckles 9 is set between the two second knuckles 10. Then, the hinge pins 6 are inserted in the bores 11 of the first knuckles 9 and the bores 12 of the second knuckles 10 in the direction of the arrows shown in FIG. 5 such that the flat facets 3 of the hinge pins 6 are mated with the flat surface 20 of the second knuckles 10, respectively, to restrain the hinge pins 6 from turning (rotating) when the lid 4 is opened or closed.

The operation of the present invention will be described with reference to FIGS. 6 to 11. The lid 4 is turned (pivots) on the hinge pins 6 in the direction of the arrow indicating the closing direction of the lid 4 shown in FIG. 5 to a closed position shown in FIG. 6. The lid 4 is held by a hand. FIG. 7 shows the positional relation between the lid 4 and the waterproof seal 7 in a state shown in FIG. 6. After the lid 4 has been set with its joining surface extended substantially parallel to the joining surface of the case body 5 as shown in FIG. 7, in order to press the lid 4 to the waterproof seal 7 perpendicularly to the contact surface of the lid 4 and the case body 5, the distance b between the respective joining surfaces of the lid 4 and the case body 5 and the height a of the waterproof seal 7 must meet an inequality: $b \geqq a$. If the distance b is greater than the height a, a gap of a thickness $b-a$ is formed between the lid 4 and the waterproof seal 7. Thus the gap prevents the waterproof seal 7 from being twisted by the lid 4 when the lid 4 is closed. In the trial case, the height a was 1.2 mm and the distance b was 1.5 mm.

Figure 7:
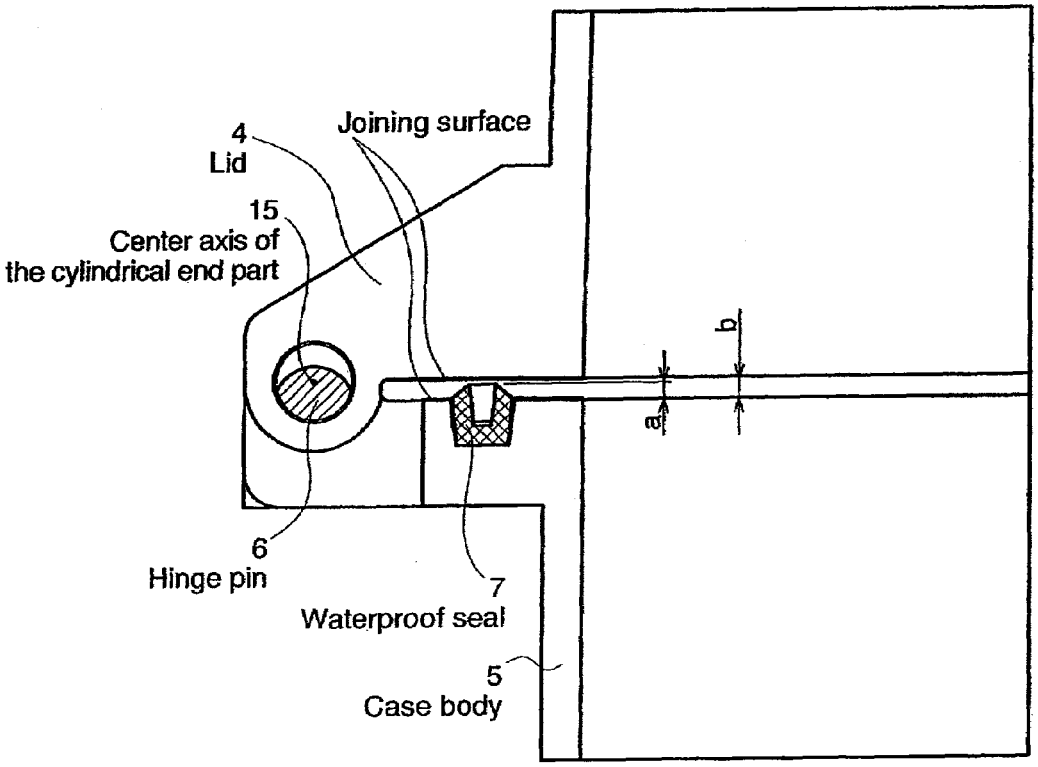
FIG. 7 is an enlarged, fragmentary side elevation of the case before the lid is completely closed.
Figure 8:
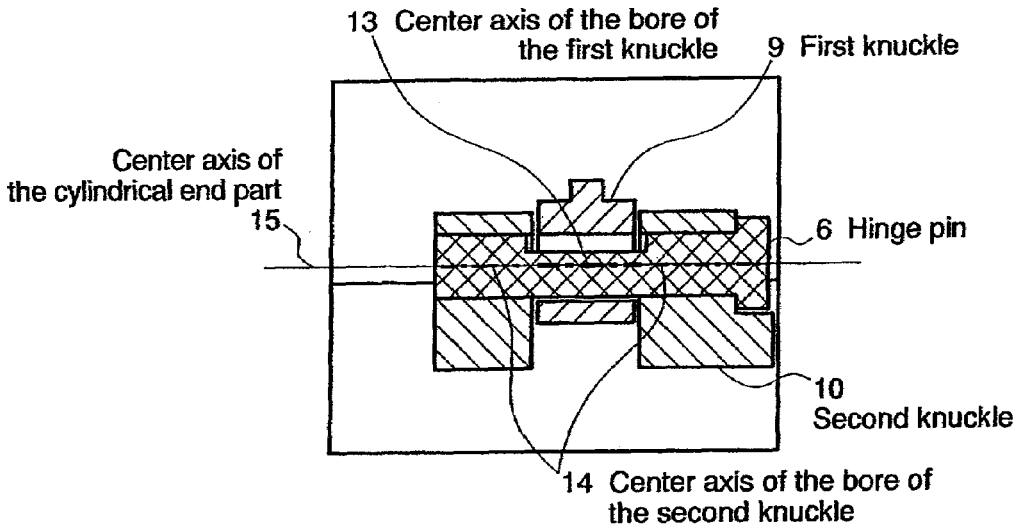
FIG. 8 is a sectional view of a hinge in a state where the lid is supported by the hand.

FIG. 8 is a sectional view of the hinge in the state shown in FIG. 7, where the lid 4 is supported by the hand. Therefore, the center axis 13 of the bore 11 of the first knuckle 9, the center axes 15 of the cylindrical end parts 1 and the center axes 14 of the bores 12 of the second knuckles 10 are aligned. The respective joining surfaces of the lid 4 and the case body 5 must be spaced the distance b apart in the state shown in FIG. 7 where the center axes 13 and 15 are aligned.

Figure 6:
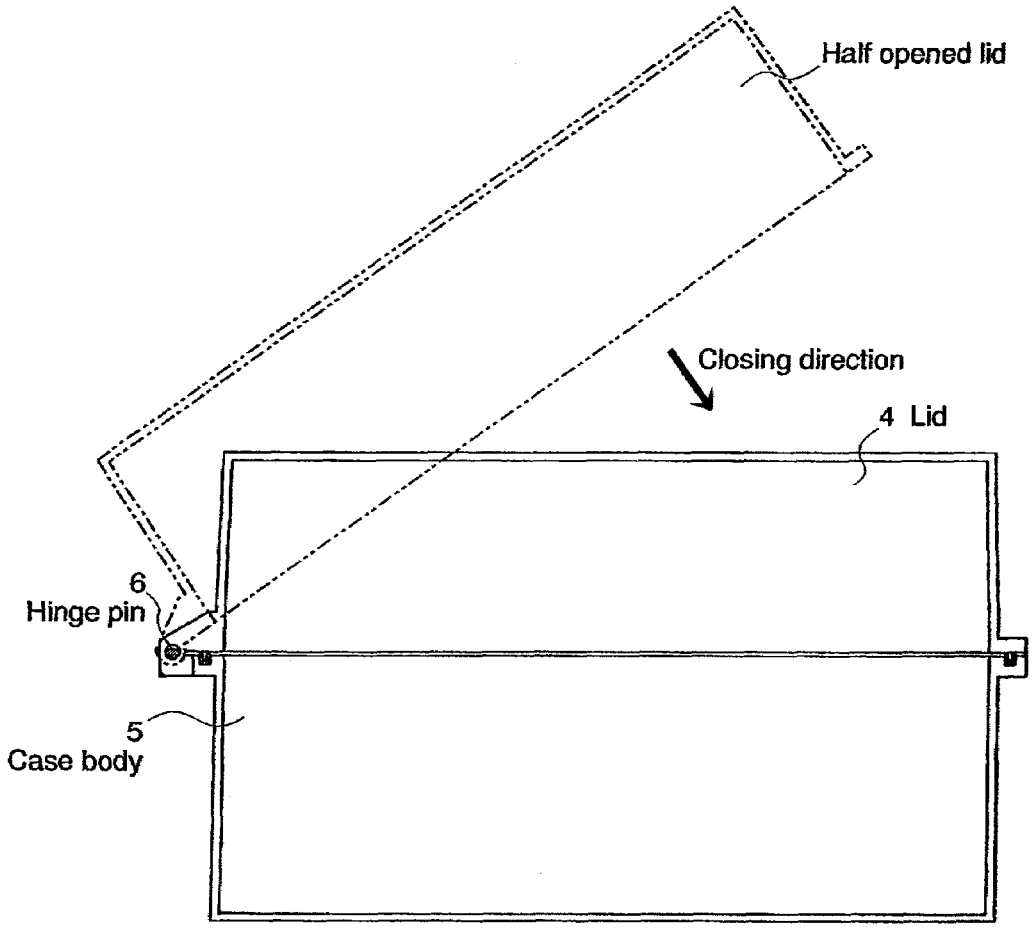
FIG. 6 is a side elevation of the case before the lid is completely closed.

When the lid is released from the hand after the lid 4 has been set with its joining surface extended substantially parallel to the joining surface of the case body 5 as shown in FIG. 6, the lid 4 drops by gravity on to the waterproof seal 7 to compress the waterproof seal 7 perpendicularly to the joining surface. The compression of the waterproof seal 7 is dependent on the sum of the respective masses of the lid 4 and devices held in the lid 4, the size, the hardness the shape of the lip and the thickness of the waterproof seal 7. In an example shown in FIG. 9, the waterproof seal 7 is compressed and deformed such that the thickness of the gap between the joining surfaces is e.

Figure 9:
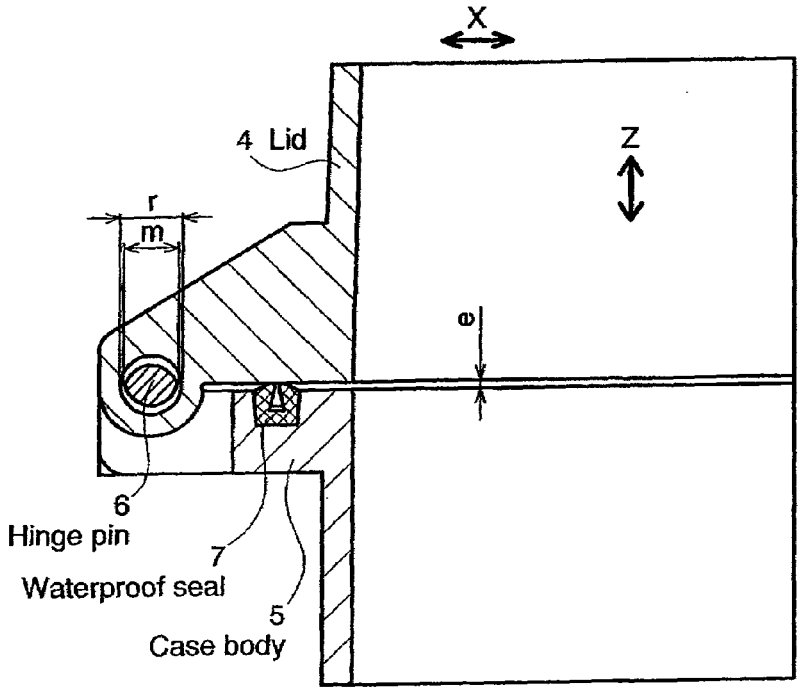
FIG. 9 is an enlarged sectional view of a waterproof seal partly compressed by the weight of the lid.

The relation between the diameter r of the bore 11 of the first knuckle 9 and the width m of the offset middle part 2 of the hinge pin 6 is important. The offset middle part 2 of the hinge pin 6 is able to move in a wide range in the directions of the arrows Z in the bore 11 of the first knuckle 9 but the hinge pin 6 has low durability when the width m is wide. The offset middle part 2 of the hinge pin 6 is able to move only in a narrow range in the directions of the arrows Z in the bore 11 of the first knuckle 9 but the hinge pin 6 has high durability when the width m is narrow. In the trial case, the diameter r was 6.0 mm, the width m is slightly smaller than the diameter v of 5.8 mm of the cylindrical end parts 1. The lid 4 is restrained from movement in the directions of the arrows X and can be moved in the directions of the arrows Z when the offset middle part 2 is formed in an elliptic sectional shape having a major axis parallel to the joining surfaces as shown in FIG. 9.

Figure 10:
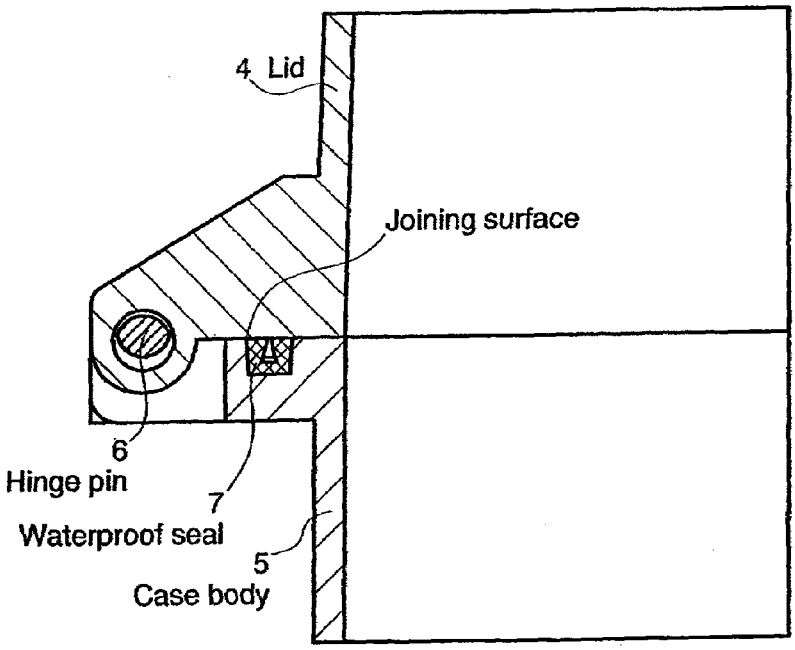
FIG. 10 is an enlarged sectional view of the case in a state where the lid is completely closed.
Figure 11:
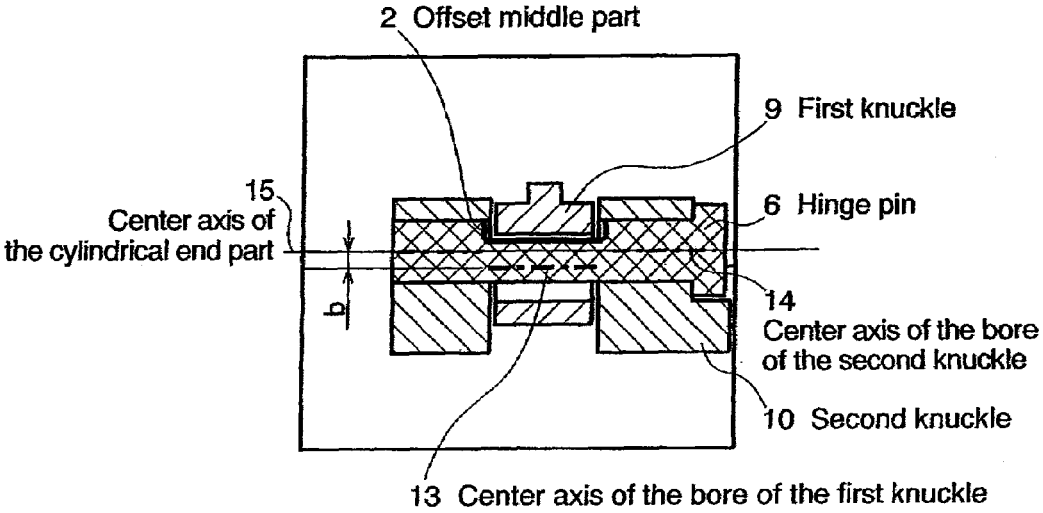
FIG. 11 is a sectional view of the hinge in a state where the lid is closed completely.

The lid 4 is fastened to the case body 5 with the fixing bolts 8 so that the respective joining surfaces of the lid 4 and the case body 5 are in close contact with each other and the waterproof seal 7 is compressed as shown in FIG. 10. FIG. 11 is a sectional view of the hinge in the state shown in FIG. 10, where the lid 4 is joined closely with the case body 5. As shown in FIG. 11, the center axis 13 of the first knuckle is shifted by a shifting distance b from the respective center axes 14 and 15 of the bores 12 of the second knuckles 10 and the cylindrical end parts 1. The shifting distance b is equal to the aforesaid distance b mentioned in connection with FIG. 7. FIG. 11 shows a state where the lid 4 has been fastened to the case body 5 with the fixing bolts 8 and the first knuckle 9 of the lid 4 has sunk in the groove defined by the inner end surfaces of the cylindrical end parts 1 and the offset middle part 2. The depth of the groove between the cylindrical end parts 1 is equal to or greater than the shifting distance b. Thus, the waterproof seal 7 can be compressed perpendicularly to the joining surface of the case body 5.

Since the lid 4 turns on the offset middle part 2 of the hinge pin 6, the lid 4 can be shifted in a direction perpendicular to the joining surface of the case body 5 by the distance corresponding to the depth of the groove defined by the cylindrical end parts 1 and the offset middle part 2. Consequently, the lid 4 can be accurately positioned relative to the case body 5 without twisting the waterproof seal 7.

Figure 12:
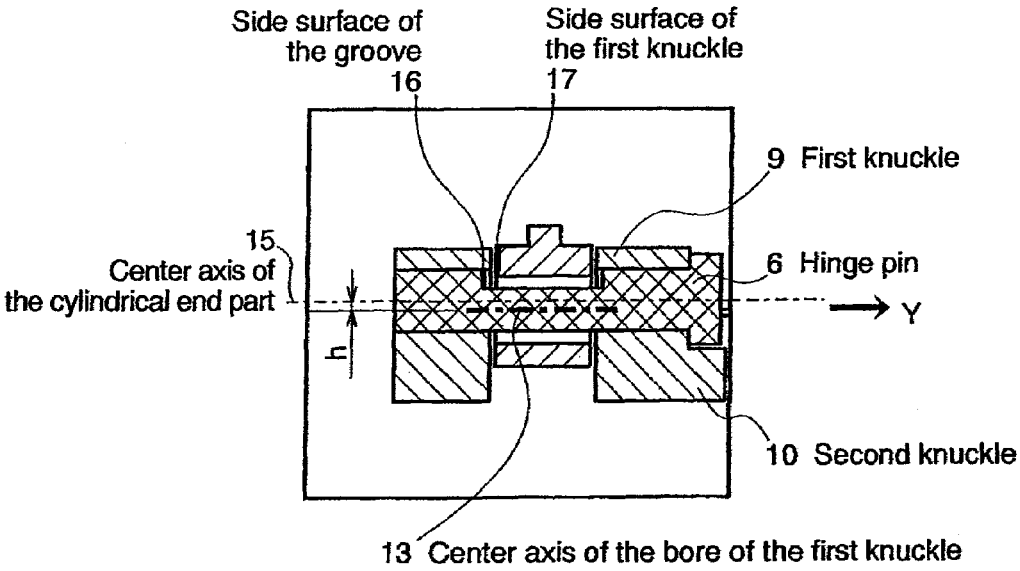
FIG. 12 is a sectional view of the hinge in a state where the lid has sunk by gravity.
Figure 13:
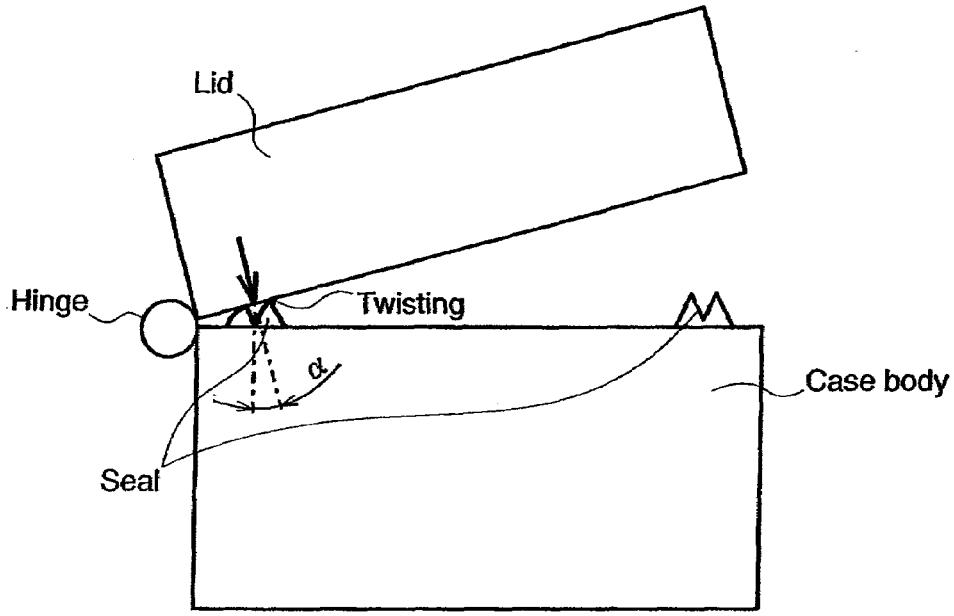
FIG. 13 is a sectional view of a conventional case.
Figure 14:
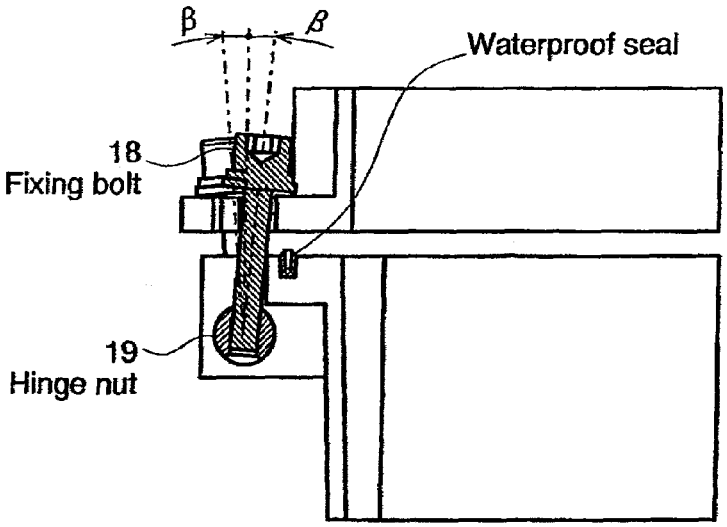
FIG. 14 is a sectional view of a conventional case.
Figure 15:
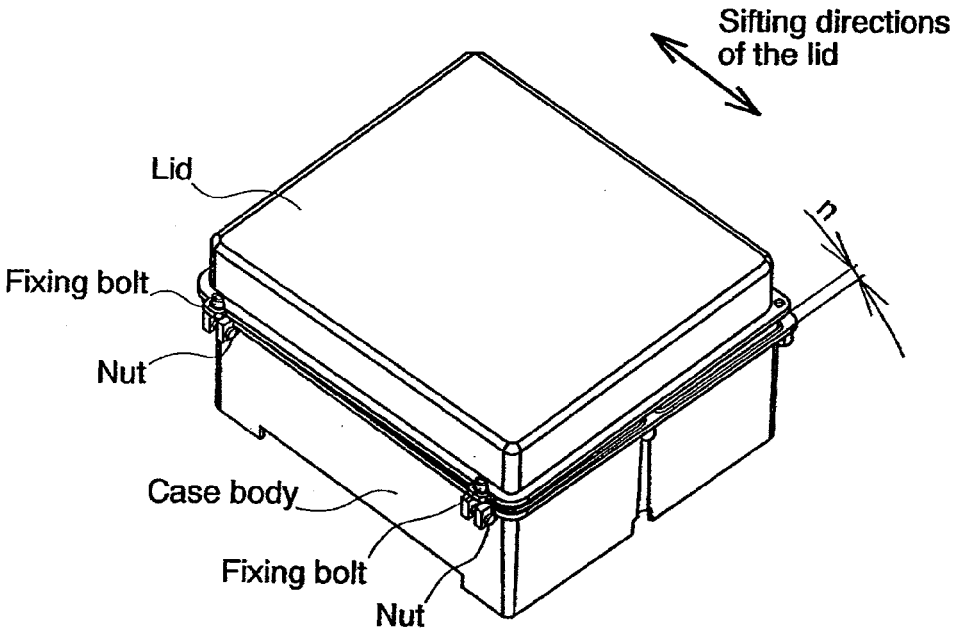
FIG. 15 is a perspective view of a conventional case.

A hinge pin retaining mechanism will be described with reference to FIG. 12 showing the hinge in the state shown in FIG. 9 in a sectional view. The lid 4 drops by gravity toward the case body 5 and the first knuckle 9 of the lid 4 sinks in the groove corresponding to the offset middle part 2. Consequently, the center axis 13 of the first knuckle 9 is shifted by a distance h from the center axes 15 of the cylindrical end parts 1. Even if a force is exerted on the hinge pin 6 in the direction of the arrow Y, one of the side surfaces 16 of the groove corresponding to the offset middle part 2 strikes against one of the end surfaces 17 of the first knuckle 9 of the lid 4 and hence the hinge pin 6 is unable to move axially and to come off the knuckles 9 and 10. When the lips of the waterproof seal 7 are formed in a hardness and a shape so that the lips can be easily deformed when the same are pressed, the waterproof seal 7 can be compressed by the lid 4 and the hinge pin 6 can be restrained from coming off before the lid is fastened to the case body with the fixing bolts 8.

The foregoing discloses a case for containing electronic devices, provided with a case body, a lid, hinges supporting the lid on the case body and a waterproof seal placed on the joining surface of the case body so as to be compressed perpendicularly to the joining surface of the case body.

What is claimed is:

1. A case comprising:

a case body, said case body having a joining surface;

a lid hingedly connected to said case body, said lid having a joining surface;

a seal disposed between said joining surface of said case body and said joining surface of said lid, wherein said seal is in contact with both joining surfaces when said lid is in a closed position; and a hinge comprising:

a first knuckle formed on one of said case body and said lid;

two second knuckles formed on the other of said case body and said lid, said second knuckles spaced apart to receive said first knuckle in interdigitated fashion; and a hinge pin comprising a shaft, said shaft comprising a first segment, a second segment, and a recessed segment disposed between said first and second segments, thereby forming a groove between said first and second segments, said shaft further comprising a pin axis about which said lid can pivot, said first and said second knuckles each having an opening through which said hinge pin can be inserted, said first and second segments and said recessed segment being configured such that said first and second segments are in alignment with said second knuckles and said recessed segment is in alignment with said first knuckle.

2. The case of claim 1 wherein said first and second segments of said shaft are clear of said first knuckle, wherein said first knuckle can be partially received in said groove during operation of said lid.

3. The case of claim 2 wherein said hinge pin further comprises a flanged end, wherein one of said second knuckles has a first flat surface, wherein said flanged end has a second flat surface such that said first flat surface engages said second flat surface when said hinge pin is inserted in said knuckles, thereby preventing rotation of said hinge pin about said pin axis during opening and closing operations of said lid.

4. The case of claim 2 wherein said first knuckle is formed on said lid and said second knuckles are formed on said case body.

5. The case of claim 2 further comprising a second hinge.

6. The case of claim 1 wherein said seal is a waterproof material.

7. The case of claim 1 wherein said seal is a compressive material.

8. The case of claim 1 wherein said seal is disposed on said joining surface of said case body.

9. The case of claim 1 wherein said first knuckle is formed on said lid and said second knuckles are formed on said case body.

10. The case of claim 1 further comprising a second hinge.

11. The case of claim 1 wherein said hinge pin further comprises a flanged end, wherein one of said second knuckles has a first flat surface, wherein said flanged end has a second flat surface such that said first flat surface engages said second flat surface when said hinge pin is inserted in said knuckles, thereby preventing rotation of said hinge pin about said pin axis during opening and closing operations of said lid.

12. The case of claim 11 wherein said seal is disposed on said joining surface of said case body.

13. The case of claim 11 wherein said first knuckle is formed on said lid and said second knuckles are formed on said case body.

14. The case of claim 11 further comprising a second hinge.

15. A case comprising:

a case body, said case body having a first contacting surface;

a lid hingedly connected to said case body, said lid having a second contacting surface;

a seal disposed between said first and second contacting surfaces, said seal being pressed between said first and second contacting surfaces when said lid is in a closed position; and a first hinge and a second hinge, each of said first and second hinges comprising:

a first knuckle formed on one of said case body and said lid;

two second knuckles formed on the other of said case body and said lid; and a hinge pin comprising a shaft having a generally cylindrical shape and a recessed region formed along said cylindrical shape, said shaft further comprising a pin axis about which said lid can pivot, said first knuckle being interleaved between said second knuckles and connected by said hinge pin, said recessed region spanning a width greater than a width of said first knuckle and aligned with said first knuckle so that during closing and opening operations of said lid said first knuckle is partially received in said recessed region and said second knuckles are journaled on said hinge pin other than on said recessed region.

16. The case of claim 15 wherein said seal is a waterproof material.

17. The case of claim 15 wherein said seal is a compressive material.

18. The case of claim 15 further comprising a seal disposed on one of the first and second contacting surfaces.

19. The case of claim 15 wherein said hinge pin of each of said hinges is configured to prevent rotation about its pin axis during operation of said lid.

20. The case of claim 15 wherein for each of said hinges its hinge pin further comprises a flanged end, wherein one of its second knuckles has a first flat surface, wherein said flanged end has a second flat surface such that said first flat surface engages said second flat surface when said each hinge pin is inserted in its knuckles, thereby preventing rotation of said each hinge pin about its pin axis during opening and closing operations of said lid.

* * * * *